US007845125B2

(12) United States Patent
Lambertini

(10) Patent No.: US 7,845,125 B2
(45) Date of Patent: Dec. 7, 2010

(54) PROFILE FOR SLIDING WINDOWS OR DOORS, METHOD FOR MAKING THE PROFILE, AND WINDOW OR DOOR OBTAINED WITH THE PROFILE

(75) Inventor: Marco Lambertini, San Lazzaro di Savena (IT)

(73) Assignee: GSG International S.p.A., Budrio (IT)

( * ) Notice: Subject to any disclaimer, the term of this patent is extended or adjusted under 35 U.S.C. 154(b) by 256 days.

(21) Appl. No.: 11/845,518

(22) Filed: Aug. 27, 2007

(65) Prior Publication Data

US 2008/0245027 A1 Oct. 9, 2008

(30) Foreign Application Priority Data

Apr. 3, 2007 (IT) ..... BO2007A0242

(51) Int. Cl.
*E06B 1/04* (2006.01)

(52) U.S. Cl. ..... 52/207; 52/212; 52/217; 52/204.51; 49/428

(58) Field of Classification Search ..... 52/207, 52/204.1, 204.5, 208, 848, 204.51, 204.591–204.599, 52/656.2–656.9, 717.01, 717.02, 172, 786.11, 52/212, 217, 204.54, 204.56, 204.71; 49/504, 49/428, 432, 408, 471, 468, 467, 458, 404, 49/431, 121, 123, 475; 403/292, 293, 295, 403/300, 313, 401, 37, 310, 312, 286
See application file for complete search history.

(56) References Cited

U.S. PATENT DOCUMENTS 3,340,663 A * 9/1967 Collard ..... 52/775
3,402,510 A * 9/1968 Johnson ..... 49/414
3,462,884 A * 8/1969 La Bissoniere ..... 49/404
3,487,580 A * 1/1970 Holliday ..... 49/372
3,503,169 A * 3/1970 Maki et al. ..... 52/209
3,600,857 A * 8/1971 Barge et al. ..... 49/324
4,222,200 A * 9/1980 Beirnes ..... 49/63
4,257,202 A * 3/1981 Biro ..... 52/204.51

(Continued)

FOREIGN PATENT DOCUMENTS

BE 1 008 120 A3 1/1996

(Continued)

OTHER PUBLICATIONS

European Search Report for EPO App. No. 07113611.3-2303, European Patent Office, Dec. 18, 2007, pp. 1-4.

*Primary Examiner*—Richard E Chilcot, Jr.
*Assistant Examiner*—James Ference
(74) *Attorney, Agent, or Firm*—Pearne & Gordon LLP

(57) ABSTRACT

A profile for making frames for sliding windows or doors comprising, amongst other things, at least one fixed frame formed by two crosspieces and two stiles; a profile, forming at least a first lower crosspiece, comprises two sliding tracks, parallel with one another, and made from a lower base body; the profile forming the lower crosspiece is divided, transversally, into two halves substantially equal and associated, at respective ends, with a matching element for connecting and joining the halves; the connecting and joining element therefore forming the central portion of the lower crosspiece and having heat insulation properties; the present invention also relates to a method for making the profile and a sliding window or door obtained with the profile.

26 Claims, 6 Drawing Sheets

U.S. PATENT DOCUMENTS

| | | | | | |
|---|---|---|---|---|---|
| 4,286,716 | A | * | 9/1981 | Budich et al. | 206/577 |
| 4,370,830 | A | * | 2/1983 | Schaefer et al. | 49/413 |
| 4,447,985 | A | * | 5/1984 | Weber et al. | 49/400 |
| 4,478,020 | A | * | 10/1984 | Jackson | 52/309.13 |
| 4,483,099 | A | * | 11/1984 | Schmidt | 49/63 |
| 4,495,726 | A | * | 1/1985 | Lindstrom | 49/401 |
| 4,554,770 | A | * | 11/1985 | Anders | 52/204.51 |
| 4,569,154 | A | * | 2/1986 | Bayer | 49/504 |
| 4,674,246 | A | * | 6/1987 | Giguere | 52/204.51 |
| 4,680,905 | A | * | 7/1987 | Rockar | 52/200 |
| 4,691,487 | A | * | 9/1987 | Kessler | 52/209 |
| 4,763,446 | A | * | 8/1988 | Kelly | 49/407 |
| 4,768,316 | A | * | 9/1988 | Haas | 52/71 |
| 4,875,316 | A | * | 10/1989 | Johnston | 52/204.593 |
| 4,922,666 | A | * | 5/1990 | Rotter et al. | 52/66 |
| 5,038,538 | A | * | 8/1991 | Rozon | 52/213 |
| 5,099,624 | A | * | 3/1992 | Valentin | 52/207 |
| 5,103,589 | A | * | 4/1992 | Crawford | 49/125 |
| 5,280,686 | A | * | 1/1994 | Davies | 49/209 |
| 5,285,606 | A | * | 2/1994 | Hagemeyer | 52/204.68 |
| 5,341,600 | A | * | 8/1994 | Heppner | 49/471 |
| 5,653,060 | A | * | 8/1997 | Kitada et al. | 49/404 |
| 6,094,874 | A | * | 8/2000 | Manzella | 52/204.62 |
| 6,098,355 | A | * | 8/2000 | Li | 52/212 |
| 6,209,269 | B1 | * | 4/2001 | Valderrama | 52/171.3 |
| 6,243,999 | B1 | * | 6/2001 | Silverman | 52/204.51 |
| 6,393,778 | B1 | * | 5/2002 | Ting | 52/204.5 |
| 7,065,929 | B2 | * | 6/2006 | Manzella et al. | 52/204.1 |
| 7,637,058 | B2 | * | 12/2009 | Lai | 49/425 |
| 2003/0084622 | A1 | * | 5/2003 | Hornung et al. | 52/172 |
| 2003/0201071 | A1 | * | 10/2003 | Kobayashi et al. | 160/10 |
| 2005/0166494 | A1 | * | 8/2005 | Guhl | 52/204.1 |
| 2006/0026913 | A1 | * | 2/2006 | Turner | 52/204.5 |

FOREIGN PATENT DOCUMENTS

| | | | | |
|---|---|---|---|---|
| DE | 28 39 740 | A1 | | 3/1980 |
| EP | 1 400 653 | A1 | | 3/2004 |
| GB | 2062734 | A | * | 5/1981 |
| GB | 2110283 | A | * | 6/1983 |
| GB | 2127470 | A | * | 4/1984 |
| GB | 2197903 | A | * | 6/1988 |

* cited by examiner

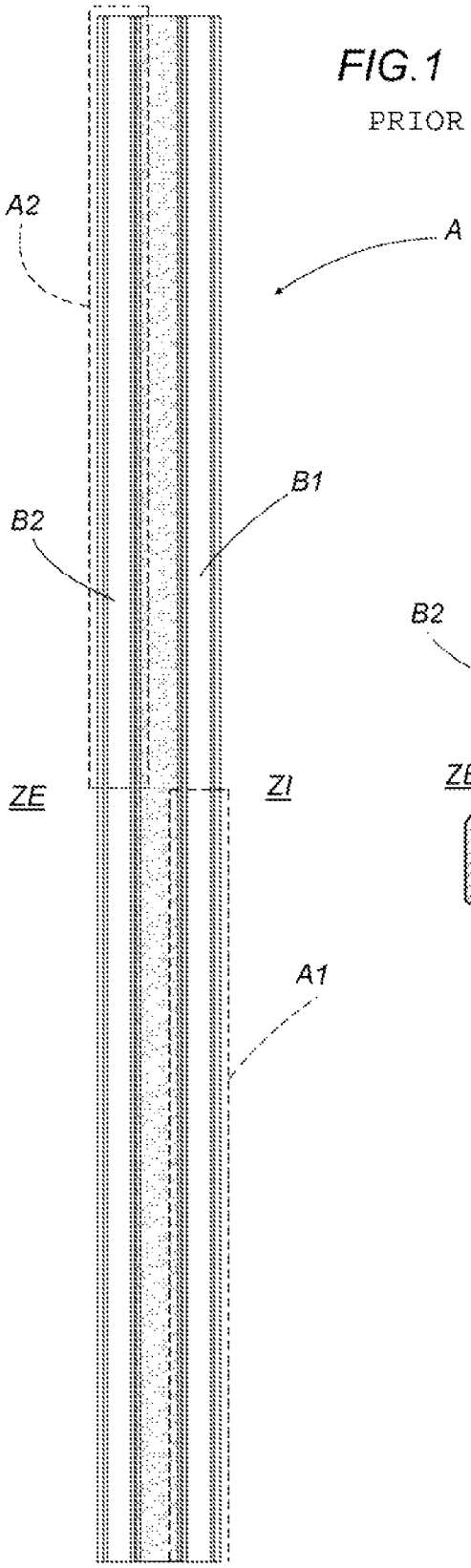
FIG.1
PRIOR ART
PRIOR ART
FIG.2
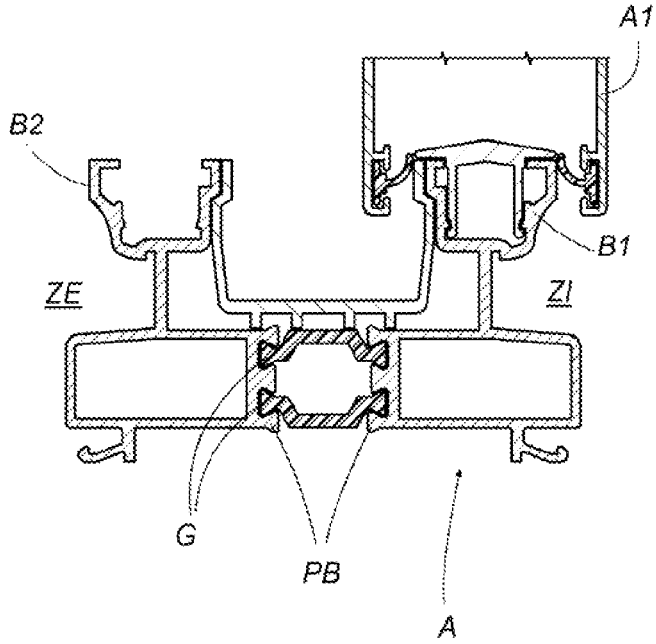

PROFILE FOR SLIDING WINDOWS OR DOORS, METHOD FOR MAKING THE PROFILE, AND WINDOW OR DOOR OBTAINED WITH THE PROFILE

BACKGROUND OF THE INVENTION

The present invention relates to a profile for sliding windows or doors, the method for obtaining this profile and the window or door which can be obtained with this profile.

The sliding windows or doors usually consist of:

- a fixed frame (the most simple and usual versions also having a fixed sash positioned on a first track);
- at least one movable frame or sash which slides horizontally opening and closing relative to the fixed frame (parallel with the fixed sash);
- a pair of carriages, associated on the lower crosspiece of the movable sash and resting on a second horizontal track (parallel with the first track on which the fixed sash rests), and designed to allow the movable sash to slide in both directions;
- a control element positioned on the sash and designed to control operating means with which it is possible, respectively, to release the sash relative to the fixed frame and allow it to slide so that it opens, and to lock the sash in a closed position, in which it is stably associated with the fixed frame;
- closing means acting at least between the vertical stile of the sash and the vertical stile of the fixed frame (opposite one another and in contact in the closed configuration).

The sliding window or door structured in this way is amongst the most widespread and most used on the market, since it has a high level of active safety and is suitable for architectural solutions which require large glass window or door surfaces combined with limited overall dimensions.

However, in contrast to these undoubted advantages of the sliding window or door there is an insufficient level of heat insulation relative to the other types of windows or doors (see for example windows and doors with tilt and turn opening).

The causes of this insufficient heat seal may mostly be attributed (partly based on the many tests carried out) to the fixed frame of the window or door.

More precisely, the lower rail A and upper rail of the fixed frame, rails consisting of a base profile PB from which the two tracks B1 and B2 emerge, having common surfaces between the inner zone ZI and the outer zone ZE of the environment in which the window or door is mounted: said common zones are identifiable, in particular, in the above-mentioned parallel pair of sliding tracks B1 and B2.

The architecture used to allow the sliding of the sash or sashes A1 and A2, with relative overlapping of the sashes, leaves uncovered a good part of the surfaces corresponding to the sliding tracks B1 and B2, in the sense that there is a passage of heat between the outside and the inside (see FIGS. 1 and 2).

To overcome this deficiency there are currently solutions defined as being of the "thermal break" type, which can be produced on extruded aluminum profiles and substantially consist of bars G of polyamide (a material with a low level of heat transmission) which separates—in the middle—along the whole length the profile of each crosspiece of the window or door.

Thermal energy, that is to say heat, flows from one environment to another in three basic ways: conduction, convection, irradiation. The direction of transmission is from the environment with the higher temperature towards the environment with the lower temperature. If the two environments are separated by a partition, the amount of heat which passes through it is proportional to the difference in temperature.

In the case of the sliding windows or doors (as clearly shown in FIGS. 1 and 2), this thermal break system on the frame does not allow acceptable performance to be achieved because the metal surfaces of the rails with faces common to the outside and inside, are never completely separate and so still allow the passage of heat by conduction from the inside to the outside and vice versa on the individual tracks even in the presence of the insulating bars forming the thermal break and the presence of seals on the two sides of the profile of the movable frames or sashes present which, in the closed position, are in contact with the tracks.

Another particularly critical element of the sliding window or door as regards the heat seal is identifiable in the central zone in which the sashes A1 and A2 overlap in the closed configuration (the sashes obviously being fitted with seals on the vertical elements in the widely known way).

As FIG. 1 clearly shows, the space between the two tracks, common to the inside and the outside, may lack a heat seal: at present this zone is protected with an element G which—in theory—acts as a "seal", even if it has very approximate performance and absolutely does not allow a thermal break along the profile.

In addition to this the new energy saving regulations will make it difficult to use this type of window or door if its performance cannot be adjusted in terms of insulation.

SUMMARY OF THE INVENTION

The aim of the present invention is therefore to overcome these disadvantages by providing a profile with high level heat insulation properties, maintaining mechanical and aesthetic properties similar to those of traditional type profiles.

Another aim of the present invention is the definition of a method for making the profile with extremely simple steps and reduced additional costs.

Another aim of the present invention is to obtain a sliding window or door with the above-mentioned profile, having high level heat insulation properties, combined with simplified transport and assembly of its basic elements.

Accordingly, the present invention achieves this aim with a profile, in particular a profile for sliding windows or doors which has the technical features described in one or more of the claims herein.

Also accordingly, the present invention achieves this aim with a method for making a profile for sliding windows or doors which has the technical features described in one or more of the claims herein.

Also accordingly, the present invention achieves this aim with a sliding window or door which has the technical features described in one or more of the claims herein.

BRIEF DESCRIPTION OF THE DRAWINGS

The technical features of the invention, in accordance with the afore-mentioned aims, are clearly indicated in the claims herein and the advantages of the invention are more evident in the detailed description which follows, with reference to the accompanying drawings, which illustrate a preferred embodiment by way of example only and without limiting the scope of the invention, in which:

FIGS. 1 and 2 illustrate a profile for making sliding windows or doors of the known type, respectively in a top plan view and a schematic front view with some parts in cross-section and others cut away;

DESCRIPTION OF THE PREFERRED EMBODIMENTS

Figure 3:
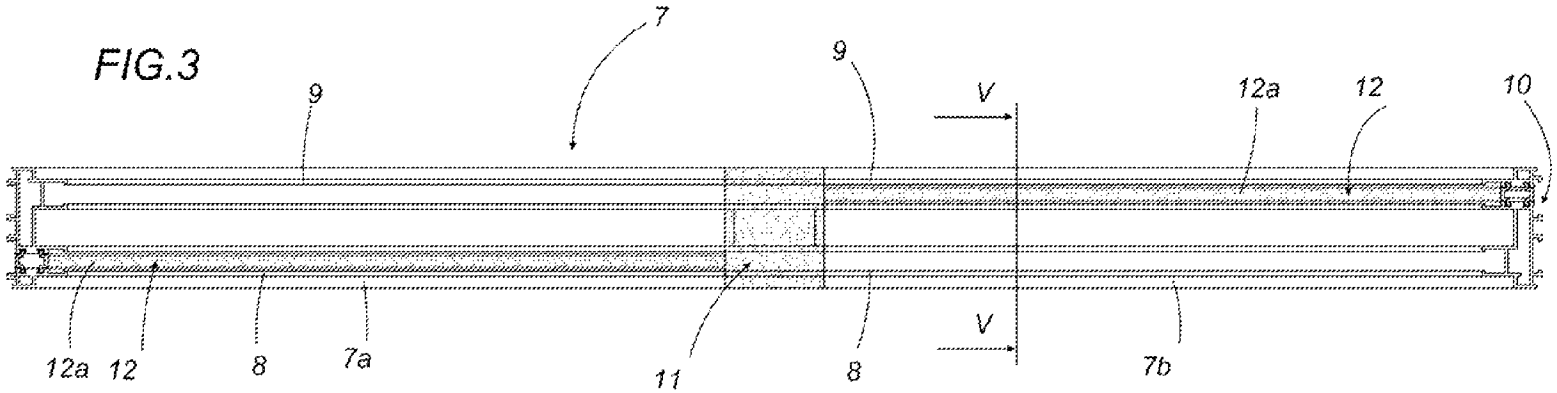
FIG. 3 is a top plan view of a profile for making sliding windows or doors in accordance with the present invention.
Figure 4:
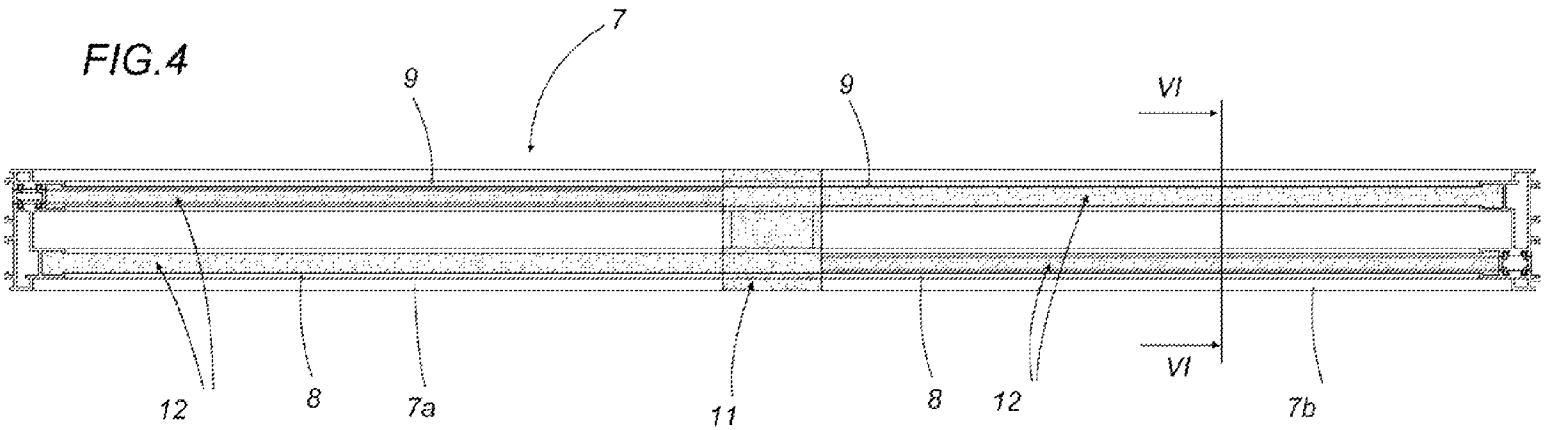
FIG. 4 is a top plan view of an alternative embodiment of the profile of FIG. 3.
Figure 12:
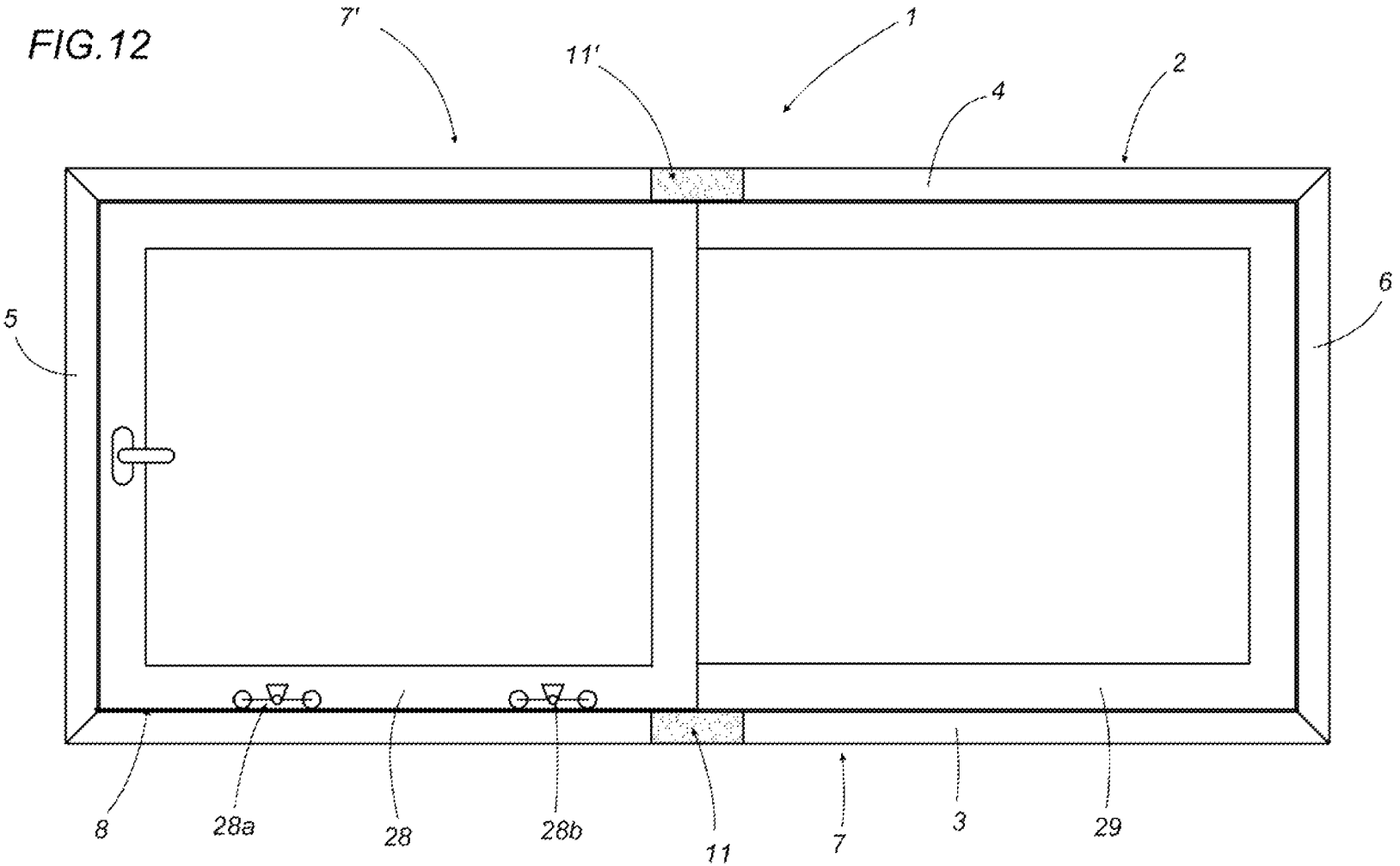
FIG. 12 is a schematic front view of a sliding window or door obtained with the profile in accordance with the present invention.

With reference to the accompanying drawings, and in particular with reference to FIGS. 3, 4 and 12, the profile, labeled 7 as a whole, is used to make frames for sliding windows or doors 1 comprising, amongst other things, at least one fixed frame 2 formed by two crosspieces 3 and 4 two stiles 5 and 6.

One of the profiles, labeled 7, forming at least a first lower crosspiece 3, comprises two sliding tracks 8 and 9, parallel with one another, and emerging from a lower base body 10.

As shown in FIGS. 3 to 6, this profile 7, forming the lower crosspiece 3, is divided, transversally, into two halves 7*a* and 7*b* substantially equal and associated, at respective ends, with a matching element 11 for connecting and joining the halves 7*a*, 7*b*.

The connecting and joining element 11 basically forms the central portion of the lower crosspiece 3 and has heat insulation properties (for example, it is made of a synthetic material, such as polyamide or in any case a material suitable for the purpose).

In practice, the profile 7 is separated transversally into two parts 7*a* and 7*b* and joined by a heat insulating connecting and joining element 11 to obtain the crosspiece 3 with a central discontinuity in the tracks 8 and 9.

Similarly, the profile 7', forming the upper crosspiece 4, may be divided, transversally, into two halves substantially equal and associated, at respective ends, with a matching second element 11' for connecting and joining the same halves.

The second element 11', like the first element 11, also forms the central portion of the upper crosspiece 4 and has similar heat insulation properties.

To simplify the description, reference will be made to the features of the profile 7 or 7' without "duplicating" on each occasion the same features for one or the other of the two profiles forming the crosspieces without in any way limiting the scope of the invention.

In addition, each of the halves 7*a*, 7*b* of the profile 7, 7' forming relative crosspieces 3 and 4 may have relative heat insulation or thermal break elements 12 positioned and acting close to at least one of the first and second tracks 8 and 9.

Alternatively, each of the halves 7*a*, 7*b* of the profile 7, 7' may have relative heat insulation or thermal break elements 12 positioned and acting close to both the first and second tracks 8 and 9.

Figure 5:
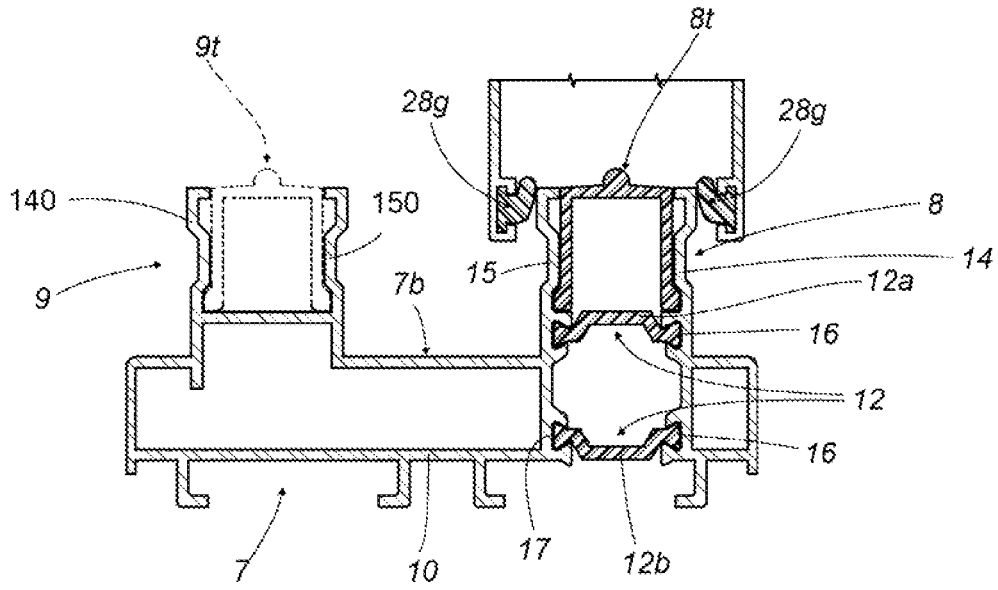
FIG. 5 is a cross-section according to V-V in FIG. 3.

More precisely, each of the halves 7*a*, 7*b* of the profile 7, 7' forming the crosspiece 3 or 4 has relative heat insulation or thermal break elements 12 positioned and acting on a relative first track 8 designed, in practice, to have at east part of its side or surface facing the outside of the closed environment protected by the window or door 1 (as shown in FIGS. 3 and 5).

Again as shown in FIG. 3, the heat insulation or thermal break elements 12 are positioned parallel with one another and offset and acting on a relative track 8, 9 of each half 7*a*, 7*b* of the profile 7, 7'.

In particular, each insulation element 12 is in contact, at one end, with the central joining element 11, 11' in such a way as to form a continuous heat insulation zone for the profile 7, 7' according to a path with a "Z"-shaped configuration in plan view along the profile 7, 7'.

As already indicated, in a different configuration, the heat insulation or thermal break elements 12 are positioned and acting on both the relative tracks 8 and 9 of each half 7*a*, 7*b* of the profile 7, 7'.

In this case (FIGS. 4 and 6) one end of each heat insulation or thermal break element 12 is in contact with the central joining element 11, 11', forming a continuous heat insulation zone for the profile 7, 7' according to a path with a "H"-shaped configuration in plan view along the profile 7, 7'.

Looking more closely at the technical details, the configurations or cross-sections of the profiles 7 and 7' may be of any type and shape, like the material, without in any way limiting the scope of the invention.

However, the basic shape of the profile 7, 7' may comprise each half 7*a*, 7*b* consisting, in cross-section, of the above-mentioned base portion 10 and two pairs of projecting arms 14, 15; 140, 150 which extend vertically, transversal to the base portion 10, and each pair 14, 15; 140, 150 forming the body of each track 8 and 9.

In this case, by way of example only and without limiting the scope of the invention, each track 8 and 9 is completed by a top track 8*t* and 9*t* where in practice carriages 28*a* and 28*b* which are part of a movable frame 28 can slide (FIG. 12).

In the specific case illustrated in FIGS. 3 and 5, each heat insulation element 12 consists of at least one pair of flat rods 12*a*, 12*b* made of a material with heat insulation properties (for example made of polyamide) for at least one track 8, 9 of each half 7*a*, 7*b*.

The rods 12*a*, 12*b* in the pair are parallel with one another, respectively positioned the first 12*a* at the base of a pair of the arms 14, 15; 140, 150 and the second 12*b* below the first rod 12*a* and at the lower zone of the base portion 10.

Each of these rods 12*a*, 12*b* has both sides associated with the profile 7, 7' by means of relative connecting channels 16, 17.

Figure 6:
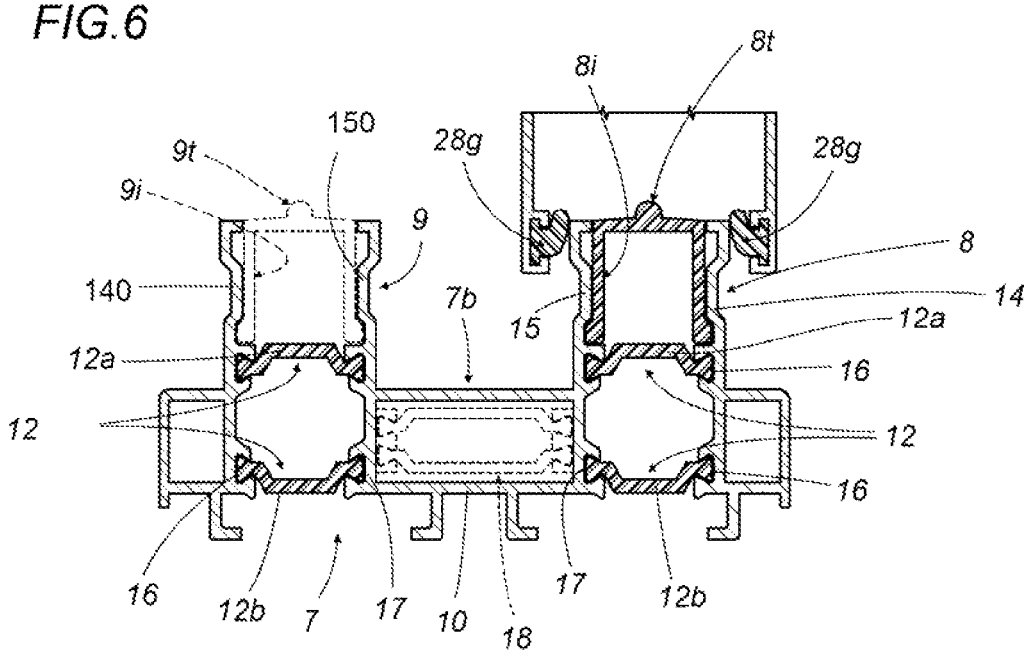
FIG. 6 is a cross-section according to VI-VI in FIG. 4.

Similarly, as visible in FIGS. 4 and 6, if the heat insulation elements 12 are present on both tracks 8 and 9, there is a pair of flat rods 12*a* and 12*b* made of a material with heat insulation properties, parallel with one another, for each track 8 and 9 of each half 7*a*, 7*b*.

Again in this case each pair of rods 12*a* and 12*b* is positioned, respectively, the first 12*a* at the base of a relative pair of arms 14, 15; 140, 150 and the second 12*b* below the first rod 12*a* and at the relative lower zone of the base portion 10.

In this case, for each rod 12*a*, 12*b* the profile 7, 7' has relative bilateral connecting channels 16 and 17 for each pair of rods 12*a* and 12*b* at each track 8 and 9 of each half 7*a*, 7*b*.

However, if an increase in the (already excellent) level of heat seal of the profile 7, 7' were required, another heat insulation or thermal break element 18 could be inserted, positioned and acting in a longitudinal central zone of each half 7*a*, 7*b* forming the profile 7, 7' (as shown with a dashed line in FIG. 6).

Again as regards the heat insulation elements 12, the latter may comprise, individually or in synergy with the rods 12*a*, 12*b*, the tracks 8 and 9 themselves.

FIG. 5 shows how, connected on the pairs of arms 14, 15; 140, 150 of the profile 7, 7' there are the tracks 8 and 9 consisting of an inner support 8*i*, 9*i* having the shape of an inverted "U", connected inside the arms 14, 15; 140, 150 and a rounded top 8*t*, 9*t*: the entire track 8, 9 formed in this way is, in this case, made in a single body and of a heat insulating material so as to create a thermal break in the relevant zone.

Figure 13:
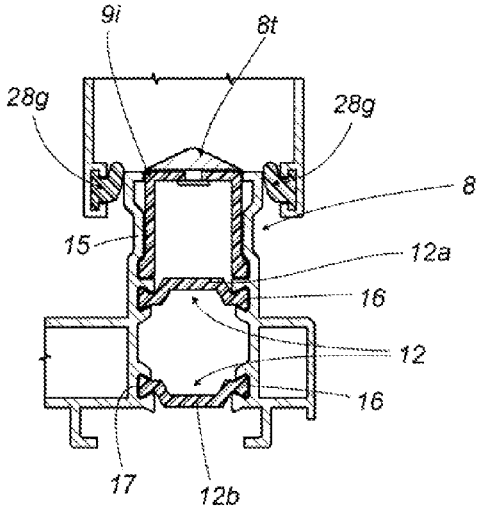
FIG. 13 is a partial cross-section of a part of the profile of FIGS. 6 and 7 with an alternative construction of the sliding tracks.

In contrast, FIG. 13 shows a "hybrid" solution of the tracks 8 and 9, in which there is a support 8*i*, 9*i* having the shape of an inverted "U" inside the arms 14, 15; 140, 150 and made of a heat insulating material, whilst the top 8*t*, 9*t* is made of a metal material, but isolated from the arms 14, 15; 140, 150. Therefore, in this way the metal top remains isolated from the profile 7, 7'.

Obviously, the embodiment may still use the conventional metal top 8*t*, 9*t* as illustrated in FIG. 2, without invalidating the embodiment.

Figure 7:
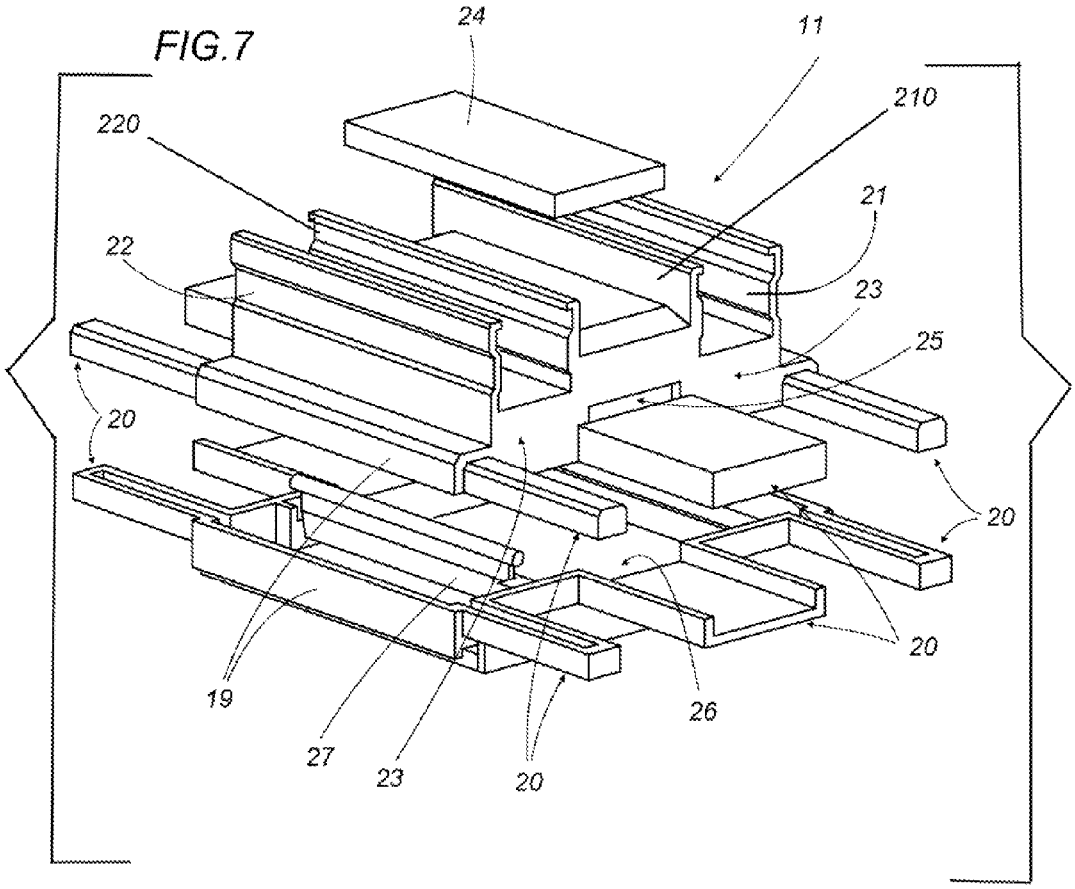
FIG. 7 is an exploded perspective view of an accessory which is part of the profile of FIGS. 3 and 4.

The above-mentioned connecting and joining element 11, 11' (see also FIG. 7) comprises:

- a base portion 19 which can be connected with a matching fit, on both sides, with the respective base ends of each half 7*a*, 7*b* of the profile 7, 7' by relative connection elements 20 projecting from both sides of the base portion 19;
- two pairs of upper projections 21, 210; 22, 220, parallel with one another, forming relative connections or joins for the first and second tracks 8 and 9 of each half 7*a*, 7*b*, and so as to obtain, in practice, a relative first and second longitudinal track 8, 9 without interruption along the entire length of the profile 7, 7'.

In more detail, for each end side in contact with the halves 7*a*, 7*b*, the base portion 19 comprises at least one vertical surface 23 for contact with the heat insulation or thermal break elements 12 positioned on the corresponding halves 7*a*, 7*b* of the profile 7, 7'.

In addition, the base portion 19 comprises, on the upper surface inserted between the two pairs of upper projections 21, 210; 22, 220, a seal element 24 or seal between the two upper zones of each half 7*a*, 7*b*.

Obviously, the projections 21, 210 and 22, 220 are already set up to be able to integrate the above-mentioned top tracks 8*t* and 9*t*.

In addition to all of that, the element 11, 11' has, at least on one end side of the base portion 19, an opening or slot 25 for the passage, in practice, of fluid, that is to say rain, so as to collect the latter in a lower part of the base portion 19, having a reservoir-style inner zone 26 for collecting the water.

Connected on one side of the lower part, in practice positioned towards the outside of the environment in which it is mounted, there is a valve element 27 designed to allow the water collected to be emptied to the outside.

Again with reference to FIG. 7, the valve element consists of a rigid wall 27 pivoting at both sides in the lower part of the base portion 19.

As illustrated in FIGS. 8 to 11, to obtain a profile 7 as described above, the following steps can be carried out:

- production of a profile 7 (for example by extrusion) with heat insulation or thermal break elements 12 positioned at least asymmetrically along the length of the profile 7 (FIG. 8);
- cutting of the single profile 7 transversally relative to the length of the tracks 8, 9, into two halves 7*a*, 7*b* (FIG. 9);
- stable association of one end of each half 7*a*, 7*b* with the connecting and joining element 11 having heat insulation properties, which can be stably connected with a matching fit with the above-mentioned ends, so as to form a single element constituting at least one of the crosspieces 3 and 4 of the fixed frame 2.

During the profile 7 production step, there is a step for asymmetrical application of the heat insulation or thermal break elements 12 close to at least one of the two tracks 8 and 9.

Alternatively, during the profile 7 production step, the heat insulation or thermal break elements 12 are applied close to both tracks 8 and 9.

Figures 8, 9, 10, 11:
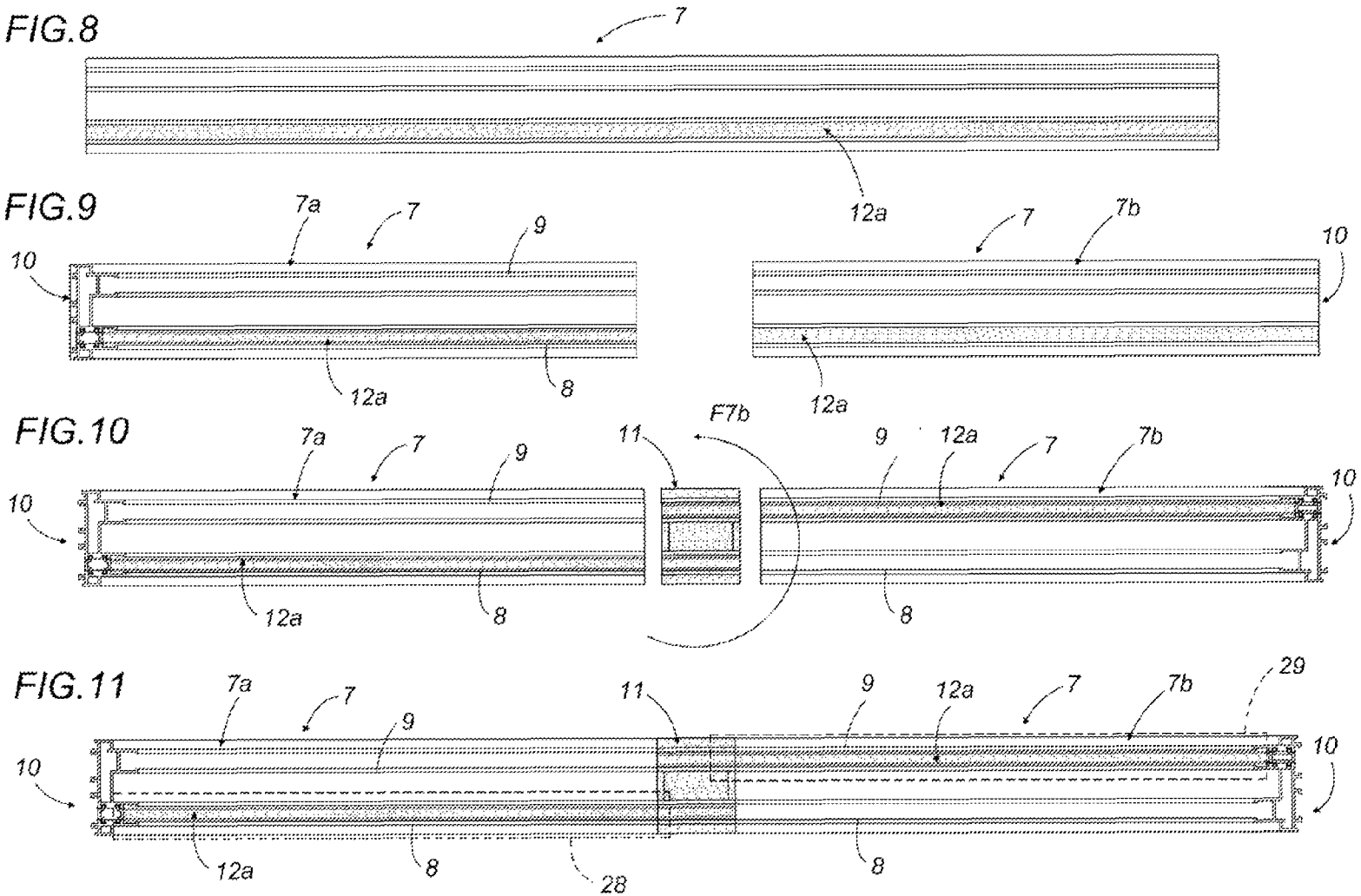
FIGS. 8 to 11 are all top plan views of the relative steps of a method for making the profile of FIGS. 3 and 4.

If the heat insulation or thermal break elements 12 are applied asymmetrically, the is a step, before the step of associating the two halves 7*a*, 7*b*, of rotation of one of the halves 7*b* (FIG. 10 arrow F7*b*), so as to associate the opposite end of the same half 7*b* with the connecting and joining element 11 and so position the tracks 8 and 9 (whose positions are inverted as shown in FIG. 10) with the relative heat insulation elements 12 offset relative to one another along the profile 7 and so as to obtain a continuous "Z"-shaped configuration of the insulation elements 12 with the connecting and joining element 11.

Basically, a sliding window or door 1 obtained with the above-mentioned profile 7 comprises at least (FIG. 12):

- a fixed frame 2 comprising at least two crosspieces 3 and 4 and two stiles 5 and 6 and in which at least a first lower crosspiece 3 is formed by the profile 7 having two sliding tracks 8 or 9 which are parallel with one another;
- at least one movable frame or first sash 28 which slides horizontally open and closed relative to the fixed frame 2, on a first track 8.

At least the above-mentioned lower crosspiece 3 of the fixed frame 2 consists of two halves 7*a* and 7*b* of the profile 7 joined to one another by a connecting and joining element 11 forming the central portion of the lower crosspiece 3 and having heat insulation properties.

Each of the halves 7*a* and 7*b* of the profile 7 has relative heat insulation or thermal break elements 12.

In addition, the upper crosspiece 4 of the fixed frame 2 can also be formed by two halves of a profile 7' joined to one another by a connecting and joining element 11' forming the central portion of the upper crosspiece 4 and having heat insulation properties. Again, each of the halves of the profile 7' has relative heat insulation or thermal break elements.

The structuring of the individual profile 7 or of both profiles 7 and 7' may involve:

- each half 7*a*, 7*b* forming the crosspieces 3 and 4 having at least one of the two tracks 8 and 9 equipped with the heat insulation elements 12 along its length, or
- each half 7*a*, 7*b* forming the crosspieces 3 and 4 having both of the tracks 8, 9 equipped with the heat insulation means 12 along the length.

FIG. 12 shows a second frame 29 positioned on the second track 9 and which may be of the fixed or movable type.

If this second frame 29 is present and in a configuration with asymmetric heat insulation elements 12 on the relative tracks 8, 9 of the corresponding half 7*a*, 7*b* the first and second movable frame 28, 29 are positioned, in a window or door 1 closed position along the parts of track 8 and 9 equipped with the heat insulation elements 12 (dashed line in FIG. 11).

This allows, in synergy with the seals 28*g* present on the edges of the two frames 28 and 29, an excellent heat seal along the profile 7, 7', specifically along the halves 7*a*, 7*b*, forming a kind of "seal wall" without interruption extending from the base of the profile 7 forming the lower crosspiece 3 to the upper part of the profile 7' forming the upper crosspiece 4 thanks to the seals, of the known type, present on the frames 28 and 29.

Therefore, with a profile structured in this way the preset aims are achieved with a simple architectural variation of the conventional type of profiles.

This allows heat seal results to be achieved which are better than those on conventional profiles.

Interrupting the lower and, if necessary, upper tracks, using the symmetry of the profile, then connecting it or rotating it through 180° and connecting it after inserting the plug allows the creation of an effective thermal barrier which, for each surface facing the outside, has a thermal break system without any uninterrupted element between the inside and the outside.

Added to this is the possibility of applying, with various solutions, the heat insulation elements acting on each half of the profile and with which it is possible to obtain improved heat seals thanks to the formation of individual thermal barriers for each half and without contact with the other half.

Finally, the profile and the method for making it provide a plurality of advantages which may be summarized as follows:

- improved overall thermal performance of the sliding window or door mounted;
- reduced working on the frame profile;
- improved resistance to infiltration by water thanks to the increase in the capacity of the drainage devices and the structuring of the joining plug;
- improved frame transportability thanks to the possibility of assembling the plugs on site and therefore with greatly reduced crosspiece sizing;
- simplification of the process for making the window or door as a whole.

The invention described above is susceptible of industrial application and may be modified and adapted in several ways without thereby departing from the scope of the inventive concept. Moreover, all details of the invention may be substituted by technically equivalent elements.

What is claimed:

1. A profile for use as a crosspiece for a sliding window or door, said profile comprising:

a first track and a second track, at least one of said tracks being a sliding track, said tracks being parallel with each other, said profile being formed of at least a first section, a second section and a third section, said first and third sections being physically separated and spaced apart from each other, said second section being a connecting and joining element which is located, with respect to the longitudinal axis of the profile, between said first and third sections and which joins said first section to said third section, said second section:

(a) being of construction material which:

(i) is different from the construction material of the first section; and (ii) is more heat insulating than the construction material of the first section; and (b) being of construction material which:

(i) is different from the construction material of the third section; and (ii) is more heat insulating than the construction material of the third section, so that said second section acts effectively as a thermal break between said first section and said third section;

said sliding track having a cross-sectional configuration, at least a portion of which is effective for engaging and guiding a sliding window or door, said portion of said configuration extending along said first section, along said second section and along said third section so that each of said first, second and third sections is configured to engage and guide a sliding window or door, at least one of the tracks extending through said first section, the portion of the track extending through the first section having a first cross-sectional profile, said first cross-sectional profile comprising a first upstanding arm, a second upstanding arm and a first rod, said arms being physically separated from and spaced apart from each other, said first rod extending between and connecting the arms, the first rod being of construction material which:

(i) is different from the construction material of the first arm and of the second arm; and (ii) is more heat insulating than the construction material of the first arm and of the second arm, so that the first rod acts effectively as a thermal break between the first arm and the second arm.

2. The profile according to claim 1, wherein said second section is a polyamide section.

3. The profile according to claim 1, wherein at least one of the tracks is a polyamide track.

4. The profile according to claim 1, wherein said first rod is a polyamide rod.

5. The profile according to claim 1, said first cross-sectional profile further comprising a second rod extending between and connecting the arms, the second rod being of construction material which:

(i) is different from the construction material of the first arm and of the second arm; and (ii) is more heat insulating than the construction material of the first arm and of the second arm, so that the second rod acts effectively as a thermal break between the first arm and the second arm.

6. The profile according to claim 5, wherein said second rod is a polyamide rod.

7. The profile according to claim 1, said track which extends through said first section also extending through said third section, the portion of the track extending through said third section also having said first cross-sectional profile.

8. The profile according to claim 7, said first track extending through said first and third sections, said second track extending through said first and third sections, the portions of the first and second tracks extending through the first and third sections having said first cross-sectional profile.

9. The profile according to claim 1, said track extending through said first section being said first track, said second track extending through said third section, the portion of the second track extending through the third section also having said first cross-sectional profile.

10. The profile according to claim 1, said first cross-sectional profile further comprising an inner support in the shape of an inverted U located between said arms, the inner support being of construction material which is different from and more heat insulating than the construction material of the first arm and the construction material of the second arm, so that the inner support acts effectively as a thermal break between the first arm and the second arm.

11. The profile according to claim 10, wherein said inner support is a polyamide inner support.

12. The profile according to claim 10, wherein the central portion of the inner support has a rounded top.

13. The profile according to claim 10, wherein the central portion of the inner support has a top made of metal, the top being isolated from the arms.

14. A sliding window or door apparatus comprising:

a frame and a sliding window or door located within said frame, said frame comprising two crosspieces and two stiles, one of said crosspieces being a profile, said profile comprising a first track and a second track, at least one of said tracks being a sliding track, said tracks being parallel with each other, said profile being formed of at least a first section, a second section and a third section, said first and third sections being physically separated and spaced apart from each other, said second section being a connecting and joining element which is located, with respect to the longitudinal axis of the profile, between said first and third sections and which joins said first section to said third section, said second section:

(a) being of construction material which:

(i) is different from the construction material of the first section; and (ii) is more heat insulating than the construction material of the first section; and (b) being of construction material which:

(i) is different from the construction material of the third section; and (ii) is more heat insulating than the construction material of the third section, so that said second section acts effectively as a thermal break between said first section and said third section;

said sliding track having a cross-sectional configuration, at least a portion of which is effective for engaging and guiding a sliding window or door, said portion of said configuration extending along said first section, along said second section and along said third section so that each of said first, second and third sections is configured to engage and guide a sliding window or door, at least one of the tracks extending through said first section, the portion of the track extending through the first section having a first cross-sectional profile, said first cross-sectional profile comprising a first upstanding arm, a second upstanding arm and a first rod, said arms being physically separated from and spaced apart from each other, said first rod extending between and connecting the arms, the first rod being of construction material which:

(i) is different from the construction material of the first arm and of the second arm; and (ii) is more heat insulating than the construction material of the first arm and of the second arm, so that the first rod acts effectively as a thermal break between the first arm and the second arm.

15. The apparatus of claim 14, said sliding window or door being positioned on said second track and being slidable horizontally in said second track, said apparatus further comprising a second window or door positioned on said first track.

16. The apparatus of claim 14, wherein said second section is a polyamide section.

17. The apparatus of claim 14, wherein said first rod is a polyamide rod.

18. The apparatus of claim 14, said first cross-sectional profile further comprising a second rod extending between and connecting the arms, the second rod being of construction material which:

(i) is different from the construction material of the first arm and of the second arm; and (ii) is more heat insulating than the construction material of the first arm and of the second arm, so that the second rod acts effectively as a thermal break between the first arm and the second arm.

19. The apparatus of claim 18, wherein said second rod is a polyamide rod.

20. The apparatus of claim 14, said track which extends through said first section also extending through said third section, the portion of the track extending through said third section also having said first cross-sectional profile.

21. The apparatus of claim 20, said first track extending through said first and third sections, said second track extending through said first and third sections, the portions of the first and second tracks extending through the first and third sections having said first cross-sectional profile.

22. The apparatus of claim 14, said track extending through said first section being said first track, said second track extending through said third section, the portion of the second track extending through the third section also having said first cross-sectional profile.

23. The apparatus of claim 14, said first cross-sectional profile further comprising an inner support in the shape of an inverted U located between said arms, the inner support being of construction material which is different from and more heat insulating than the construction material of the first arm and the construction material of the second arm, so that the inner support acts effectively as a thermal break between the first arm and the second arm.

24. The apparatus of claim 23, wherein said inner support is a polyamide inner support.

25. The apparatus of claim 23, wherein the central portion of the inner support has a rounded top.

26. The apparatus of claim 23, wherein the central portion of the inner support has a top made of metal, the top being isolated from the arms.

* * * * *